US011685869B2

(12) United States Patent
Agee et al.

(10) Patent No.: US 11,685,869 B2
(45) Date of Patent: Jun. 27, 2023

(54) METHOD FOR THE PRODUCTION OF SYNTHETIC JET FUEL

(71) Applicant: Emerging Fuels Technology, Inc., Tulsa, OK (US)

(72) Inventors: Kenneth L. Agee, Tulsa, OK (US); Jennifer Parker, Tulsa, OK (US)

(73) Assignee: Emerging Fuels Technology, Inc., Tulsa, OK (US)

( * ) Notice: Subject to any disclaimer, the term of this patent is extended or adjusted under 35 U.S.C. 154(b) by 0 days.

(21) Appl. No.: 17/492,324

(22) Filed: Oct. 1, 2021

(65) Prior Publication Data

US 2023/0108520 A1 Apr. 6, 2023

(51) Int. Cl.
*C10G 67/02* (2006.01)
*C10L 1/08* (2006.01)

(52) U.S. Cl.
CPC ..... *C10G 67/02* (2013.01); *C10L 1/08* (2013.01); *C10G 2300/1022* (2013.01); *C10G 2400/08* (2013.01); *C10L 2270/04* (2013.01)

(58) Field of Classification Search
CPC ..... C10G 67/02; C10G 2300/1022; C10G 2400/08; C10L 1/08; C10L 2270/04
See application file for complete search history.

(56) References Cited

U.S. PATENT DOCUMENTS 6,309,432 B1 10/2001 Wittenbrink et al.
2004/0181110 A1 9/2004 Miller et al.
(Continued)

FOREIGN PATENT DOCUMENTS

WO 2003066777 8/2003

OTHER PUBLICATIONS

International Search Report and Written Opinion International PCT Application No. PCT/US22/45525, Korean Intellectual Property Office, dated Jan. 25, 2023.

*Primary Examiner* — Ellen M McAvoy
*Assistant Examiner* — Chantel L Graham
(74) *Attorney, Agent, or Firm* — Head, Johnson, Kachigian & Wilkinson, PC

(57) ABSTRACT

A method to produce a fuel product such as jet fuel, diesel or single battlefield fuel from a Fischer Tropsch syncrude comprising the steps of: 1) Separating the HFTL product from the reactor effluent gasses at reactor temperature and partially cooling the reactor effluent gas before transferring it to the enhanced hot separator; 2) enhancing the hot separator downstream of the Fischer Tropsch reactor with trays or packing and also adding reflux of the LFTL product, to improve separation efficiency and substantially reduce the C16+ portion of the hydrocarbons in the LFTL product; 3) combining the HFTL and MFTL product to from a combined HFTL product and further processing the combined HFTL in a hydroprocessing reactor that has a stacked bed with a layer of hydrocracking catalyst to crack the waxy C20+ hydrocarbons and a layer of hydroisomerization catalyst to isomerize the light fraction to increase the iso to n-paraffin ratio of the hydroprocessed product; 4) the LFTL product that is not recycled to the hot separator as reflux, bypasses the hydroprocessing reactor and is blended with the hydroprocessed product before distillation; and 5) the combined raw LFTL product and the hydroprocessed product is distilled to make naphtha, a fuel product, and a baseoil product. The method may be modified to make a single fuel product, preferably a jet fuel product.

16 Claims, 2 Drawing Sheets

(56) References Cited

U.S. PATENT DOCUMENTS

| | | | | |
|---|---|---|---|---|
| 2010/0298451 | A1 | 11/2010 | Dandeu et al. | |
| 2011/0309000 | A1 | 12/2011 | Tanaka et al. | |
| 2016/0046869 | A1 | 2/2016 | Ishito et al. | |
| 2018/0291279 | A1* | 10/2018 | Jack | C10G 2/344 |

* cited by examiner

Process Flow Diagram

Product Separation Efficiency

METHOD FOR THE PRODUCTION OF SYNTHETIC JET FUEL

BACKGROUND OF THE INVENTION

Cross Reference

Not Applicable.

Field of the Invention

The present invention relates to a method for producing synthetic fuel products, particularly a synthetic jet fuel product. More particularly, this invention relates to a method for producing a synthetic jet fuel from a Fischer Tropsch syncrude.

Description of the Related Art

Fischer Tropsch syncrude, preferably syncrude made by a non-shifting Fischer Tropsch catalyst, comprises predominately normal paraffins (n-paraffins) also referred to as straight chain hydrocarbons with very low levels of sulfur, nitrogen, or aromatics. Additionally, the lighter fractions of the Fischer Tropsch syncrude contain small amounts of alcohols and olefins. While the linear paraffinic nature of the Fischer Tropsch syncrude is advantageous for some properties of synthetic distillate fuels, such as cetane and smoke point, these paraffinic molecules are disadvantageous for cold flow properties such as freeze point and pour point. Thus, the syncrude must be further processed by hydrocracking and optionally hydroisomerization to produce a substantial amount of iso-paraffin content, which greatly improves the cold flow properties of the final product.

It is an objective of the present invention to provide an efficient method to produce a synthetic jet fuel product in high yields with a high iso to n-paraffin ratio and a small amount of alcohols that improve the lubricity of the final jet fuel product.

SUMMARY OF THE INVENTION

The present invention is a method designed to produce high yields of a jet fuel product. Variations of the method can be used to produce other fuel products such as diesel, single battlefield fuel, or fuel products in combination with base oil products. There is increasing interest in developing methods to produce a clean jet fuel product from non-petroleum sources. Such sources can be processed in a way that results in a large reduction of greenhouse gas (GHG) emissions and the resulting fuel will burn cleaner than the petroleum-derived version. Synthetic jet fuel made with renewable feeds may also be referred to as Sustainable Aviation Fuel or SAF. One way to produce these fuel products is via the Fischer Tropsch process. The Fischer Tropsch reaction requires a feed gas comprising carbon monoxide and hydrogen, also known as synthesis gas, to make synthetic hydrocarbon products. Synthesis gas can be made by steam reforming, autothermal reforming, or partial oxidation from many different starting materials, such as natural gas, coal seam gas, or biogas, or it can be made by gasification of a solid carbonaceous feed material. The degree of GHG reduction associated with the production and use of the fuel product varies depending on the feedstock and how it is processed. Natural gas from a pipeline as a feedstock does not result in a large GHG reduction. However, gas that is being flared is completely different. Natural gas flaring is a global problem and one of the largest sources of GHG emissions in the world. Approximately 15 billion cubic feet per day of natural gas is currently being flared. At best, these flares oxidize the methane to $CO_2$ and vent it to the atmosphere with no useful product or energy recovery. A typical flare however is not 100% efficient. Recent studies have shown that in addition to producing large amounts of polluting carbon particulates, the typical flare is distorted by wind, which drives the flame away from the flare tip and reduces flare efficiency. Therefore, a typical flare releases an average of 2% to 5% of the methane that is unburned. Methane is at least 25 times more potent as a greenhouse gas than $CO_2$ and therefore the GHG equivalent of the methane slip may be greater than the $CO_2$ released from combustion.

Synthesis gas can also be produced from biogas or gasification of biomass. Biogas and biomass are considered renewable resources as they comprise carbon that was pulled out of the atmosphere by photosynthesis. When this carbon is incorporated into a fuel and the fuel is combusted it goes back to the atmosphere resulting in a carbon neutral sustainable cycle. Another source of carbon for synthesis gas is $CO_2$, which can either be extracted from the atmosphere or from a smokestack. This $CO_2$ can be converted to CO by a reverse shift reaction or by modified electrolysis, or $CO_2$ can be directly hydrogenated to make hydrocarbons. Water can be split by electrolysis into hydrogen and oxygen. Any of these sources of CO and $H_2$ can be used to produce a Fischer Tropsch hydrocarbon product that can be upgraded to fuel products such as jet fuel, diesel, or single battlefield fuel, by the method of the present invention. Sources that reduce GHG emissions are preferred.

It is an objective of the present invention to provide a method to efficiently convert Fischer Tropsch hydrocarbons into finished fuel products such as jet fuel, also known as synthetic paraffinic kerosene (SPK). The method may also be used to make synthetic diesel or a combination of jet fuel and baseoil or diesel and baseoil. This method can be used to make fuel products that are totally compatible with existing infrastructure, such as jet engines and diesel engines. Jet fuel and diesel fuel products of the present invention can be made in a way that results in a large reduction in GHG emissions.

A fuel product as defined herein is a liquid hydrocarbon fuel such as jet fuel, diesel, or single battlefield fuel or any other liquid hydrocarbon fuel product designed to meet a fuel specification for use in a turbine or internal combustion engine. Naphtha may be a fuel product, and as such may be used as a gasoline blendstock or it may be used as fuel in the process. When referred to as fuel in the process, the naphtha may be consumed by combustion or reforming and may not be recovered as a fuel product to be sold or used external to the process.

The Fischer Tropsch catalyst of the method may preferably be a non-shifting Cobalt catalyst. In a preferred embodiment, the cobalt catalyst may produce a heavy waxy syncrude. This syncrude product may typically be produced in at least two fractions, referred to herein as LFTL (Light Fischer Tropsch Liquid) and HFTL (Heavy Fischer Tropsch Liquid). The HFTL product may be separated from the LFTL product and maintained at elevated temperature to keep waxes contained therein in liquid form. A third intermediate fraction referred to herein as Medium Fischer Tropsch Liquid or MFTL, may be separated from the other intermediate products. The temperature required to keep the HFTL product liquid may also volatilize portions of the LFTL product, so once produced, these products may be kept separate until required for further processing or blending. The HFTL product may contain mostly n-paraffin molecules with small amounts of olefins and alcohols. The LFTL product may also be mostly made of n-paraffins but may contain a greater amount of olefins and alcohols compared to the amount in the HFTL product.

The present invention provides a method to take advantage of the unique qualities of the Fischer Tropsch syncrude fractions and to maximize the yield and quality of products such as jet fuel. While the preferred embodiment may produce maximum jet fuel yield even as high as 100% jet fuel, the method can also be used to make a diesel product, a single battlefield fuel product, or a combination of a fuel product and a baseoil product. Baseoil products can be used to blend into lubricants such as passenger car motor oil lubricants.

The preferred method comprises five key steps:

1) The HFTL product that is liquid at reactor effluent temperature is separated from the vapor phase reactor effluent which is sent to a cooler preferably a feed/effluent exchanger.

2) The partially condensed reactor effluent stream is sent to the enhanced hot separator downstream of the Fischer Tropsch reactor. This separator may be enhanced with trays or packing and reflux of the LFTL product to improve separation and reduce the C16+ portion of the hydrocarbons in the LFTL product. The bottoms liquid intermediate product from this separator is a MFTL product. This MFTL product is combined with the HFTL product to make a combined HFTL product. The combined HFTL product is sent to the hydroprocessing reactor.

3) The hydroprocessing reactor may have a stacked bed with a layer of hydrocracking catalyst to crack heavy waxy components and a layer of hydroisomerization catalyst to isomerize the cracked product in the fuel range, particularly the virgin or un-cracked fraction of the combined HFTL, thus increasing the iso to n-paraffin ratio of the entire product.

4) The LFTL Product that is not recycled to the hot separator may bypass the hydroprocessing reactor and may be blended with the hydroprocessed product before distillation 5) The combined raw LFTL product and the hydroprocessed product may be distilled to make one or more finished products.

In all preferred methods of the present invention, naphtha may optionally be recovered as a fuel product or recycled to the process as fuel or for production of synthesis gas. By adjusting the severity of the hydroprocessing reactor, the distillation cuts, and recycle of heavy products, the method can be used to make a number of fuel and baseoil products. The fuel product may be jet fuel, also called kerosene or SPK, diesel, or single battlefield fuel, or any other middle distillate fuel know to one skilled in the art. The fuel products made by the method herein may be characterized as having a high iso to n-paraffin ratio, preferably greater than 4:1, and a small amount of alcohol that improves the product lubricity. The high iso to n-paraffin ratio may be characteristic of the method. The enhanced hot separator may assure that more of the raw FT product in the boiling range of the final fuel product is subjected to hydroprocessing than would be possible with a conventional separator. The stacked bed of the hydroprocessing reactor may preferably contain a hydroisomerization catalyst that will efficiently isomerize the light paraffin products and further isomerize the cracked products in the fuel range. The combination may give a highly branched product with excellent cold flow properties, while the small amount of raw LFTL product that bypasses the hydroprocessing unit may contain enough alcohol content to enhance the fuel lubricity. Several examples of how the method is used to make fuel products and base oil products are given below.

Example 1

Maximum jet product yield may be achieved by running the hydroprocessing reactor of the method at high severity. High severity can be defined as hydrocracking to the degree that 60% to 95% of the C21+ is converted to C20− products. The enhanced hot separator may optimize the amount of product that is hydroprocessed. The hydroprocessed product may be combined with the raw LFTL product and sent to the distillation column where the naphtha product is recycled to be used as fuel in the process or as feed to make additional synthesis gas and the product heavier than the end point of the jet product is recycled to the hydroprocessing reactor to extinction. In this preferred embodiment of the present invention, the overall product yield is slightly less than the total yield when naphtha is not recycled but the only product is jet fuel.

Example 2

To achieve maximum diesel product yield, the method may be operated much like the maximum jet product case except the end point of the diesel is much higher than that of jet fuel and the hydroprocessing severity does not need to be as high. Product heavier than diesel may be recycled to extinction. Variations of the method can be used to simplify the configuration or alter the product properties. For example, in the maximum diesel product case the hydroprocessing severity can be set high enough that the end point of the diesel product is met by hydrocracking and the distillation column becomes a stripper to remove the naphtha product only, as there is no need to recycle heavy product. Optionally the naptha may be recycled to extinction.

Example 3

Jet fuel product and base oil product or diesel fuel product and base oil product can be made by distilling the fuel product out and instead of recycling the heavy fraction to crack further into the fuel product, it can be recovered as a base oil product. The method allows for adjusting the severity of the hydroprocessing reactor and the ratio between the hydrocracking catalyst and the hydroisomerization catalyst to control the properties of both the fuel and the base oil products. The ratio of hydrocracking catalyst to hydroisomerization catalyst can be anywhere from 1:99 to 99:1. The enhanced separator assures that the small amount of alcohols in the LFTL that bypass the hydroprocessing reactor are only in the fuel distillation range and therefore only end up in the fuel product where they are desired. The hydroisomerization catalyst may be one that preferentially isomerizes the product in the distillate range or one that isomerizes product in the lube range or a mixture of two or more hydroisomerization catalysts.

In all examples, the method of the present invention comprises the five key steps that can be adjusted to optimize the desired fuel product or a fuel and base oil product properties.

Figure 1:
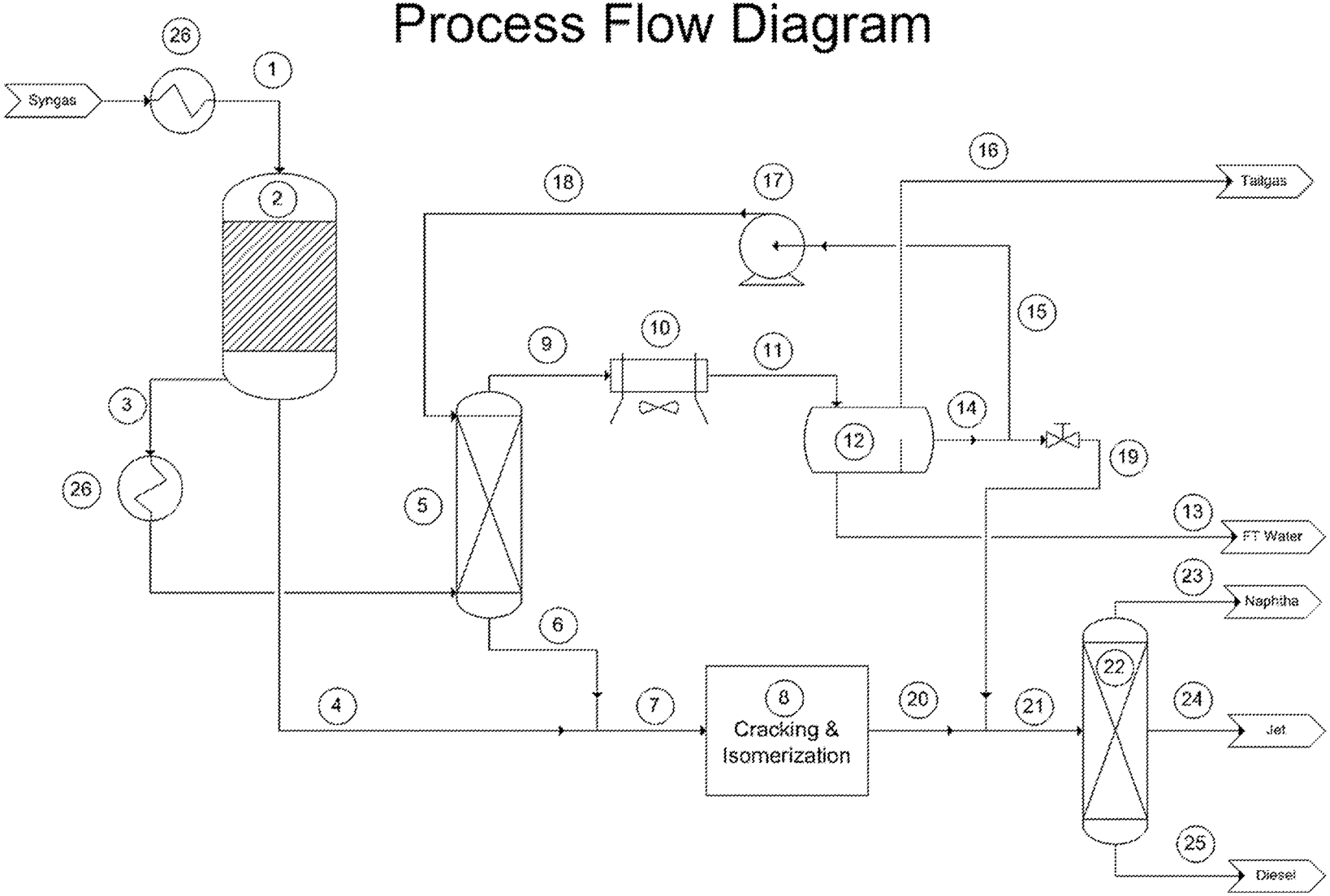
FIG. 1 is a simplified process flow diagram showing the major components of a method according to the present invention.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a method designed to produce high yields of a jet fuel product. Variations of the method can be used to produce other fuel products such as diesel, single battlefield fuel, or fuel products in combination with base oil products.

What is described herein is an integrated method to make a high-quality fuel product, such as a middle distillate fuel, particularly jet fuel. In the method, the stacked bed hydroprocessing unit is operated so that a portion of the fuel product is heavier than the endpoint of the fuel and a portion of the cracked product blended with the raw LFTL product is lighter than the fuel product. The portion of the product heavier than the fuel product is optionally removed from the bottom of the final distillation column. This product can be used as a light baseoil product or it can be recycled to extinction to increase the fuel product yield. In one preferred embodiment, the severity of the stacked bed hydroprocessing unit is high enough that the end point requirement of the fuel product (such as a diesel product) is met by the degree of hydrocracking and the final product specifications are met by simply removing the light naphtha portion to achieve an acceptable flash point. The light naphtha product can be used as a solvent or gasoline blending product or it can be used as fuel in the process or recycled to make more syngas. If both light and heavy products are recycled, the final product may be 100% of the desired fuel product. Because the method has such high jet yield, the overall yield loss when recycling naphtha to yield 100% jet is minimized. The product distillation ranges may be changed to make a naphtha/diesel product or a naphtha/single battlefield fuel product or the naphtha can be recycled to make diesel only or single battlefield fuel only. The method of the present invention comprises five steps. In the preferred embodiment, the method will produce only jet fuel. In another preferred embodiment, the method will produce a high-quality jet fuel in high yields and a high-quality light baseoil.

The method of the present invention is used to upgrade a synthetic crude derived by a Fischer Tropsch process, preferably comprising a non-shifting low temperature Cobalt catalyst. Any type of Fischer Tropsch reactor known to one skilled in the art may be used. A preferred reactor is a tubular fixed bed Fischer Tropsch reactor. In a preferred embodiment, the Fischer Tropsch synthetic crude is generated with a feedstock that results in substantial reduction of GHG emissions.

The five steps of the method are described in more detail:

Step 1.

The HFTL product is separated from the hot reactor effluent gases at the reactor exit. The vapor phase reactor effluent is cooled, preferably in a feed/effluent exchanger and sent to the enhanced hot separator.

Step 2.

The enhanced hot separator downstream of the Fischer Tropsch reactor may be enhanced with trays or packing material and a reflux of the LFTL product to improve separation efficiency. Hot vapors from the bottom head of the reactor that are partially cooled may enter the enhanced hot separator where additional waxy components are condensed and removed from the bottom of the enhanced separator. The hot liquid product that condenses in the reactor may be included in the feed to the hot separator or in the preferred embodiment described herein it bypasses the separator. The heavy product fraction that condenses from the hot reactor vapor stream is referred to as a Medium Fischer Tropsch Liquid (MFTL) which may be combined with the HFTL product from the bottom head of the Fischer Tropsch reactor. The combined product is referred to herein as combined HFTL. The enhanced features of this hot separator act as a crude distillation column and provide a sharper separation between the MFTL and LFTL products. This sharper separation improves yield and quality of the final fuel product.

Step 3.

The hydroprocessing reactor may comprise a stacked bed with a hydrocracking catalyst and a hydroisomerization catalyst. In the preferred embodiment, the hydrocracking catalyst is on top and the hydroisomerization catalyst is below. The hydrocracking catalyst targets conversion of the C21+ waxy components to make lighter products in the C20– range. These cracked products comprise mostly n-paraffins and iso-paraffins. The n-paraffin products in the C8 to C16 range that are not cracked, negatively affect the cold flow properties of the final product. It has been found that if the appropriate hydroisomerization catalyst is used in the stacked bed of the present invention, the C8 to C16 virgin fraction of the combined HFTL feed can be isomerized enough to improve the cold flow properties of the fuel products. The hydroisomerization catalyst may be one that is effective at isomerization in the distillate fuel range or it may be a mixture of hydroisomerization catalysts that also includes a catalyst capable of isomerization in the baseoil range. The LFTL product also contains C8+ molecules. If the enhanced hot separator of the present invention is designed properly, the portion of the LFTL product heavier than C16 is almost completely eliminated and the portion in the C8-C16 range is reduced. This C8+ LFTL product contains a small amount of alcohols, which will improve the lubricity of the final fuel products. It is desirable to add these molecules back into the product mix before final distillation, so they can be incorporated into the fuel products. However, this virgin cut is mostly n-paraffin so it is also desirable to limit how much bypasses the hydroprocessing reactor. The enhanced separator of Step 2 reduces the C8+ portion of the LFTL product by about 60% compared to a typical separator, leaving more of this product in the MFTL so that it can be isomerized by the hydroisomerization catalyst in the stacked bed hydroprocessing reactor.

The hydroprocessing reactor with a stacked bed may be operated at high enough severity that hydrocracking of the C21+ is on the order of 60% to 95% with an iso/n-paraffin ratio of the product above 4:1. If the hydroprocessing reactor severity is high enough when making a diesel product or a single battlefield fuel product, this high severity hydrocracking results in a product that when distilled does not require recycling of a heavy fraction. This simplifies the product distillation column design that is only used to strip out the naphtha and is easier to operate. It has been found that the hydrocracking can be operated at a severity high enough to eliminate the heavy recycle (when making diesel or single battlefield fuel) without suffering significant losses from excessive hydrocracking. While it is more efficient and preferred to stack the two catalyst in the same reactor, it is not outside the scope of the present invention to have two separate reactors in series.

Step 4.

The LFTL product that is removed by the enhanced separator will have a very limited amount of C16+ hydrocarbons in it and will contain a small amount of alcohols. This product bypasses the hydroprocessing unit thereby retaining these alcohols and is blended with the outlet of the stacked bed hydroprocessing reactor. Because of the enhanced separation efficiency of the separator there are virtually no alcohols heavier than C16 that bypass the hydroprocessing reactor. Therefore when base oils are produced they have very little or no alcohols. The small amount of alcohols that remain are in the distillate product where they are beneficial.

Step 5.

The combined LFTL and hydroprocessed products are distilled to make the final products. The distillation can be configured to make naphtha, a distillate fuel product, and a baseoil product. The distillate fuel product can be jet, diesel, or variations such as a single battlefield fuel. The naphtha can be sold as a fuel product such as a gasoline blendstock or it can be used as fuel within the process or recycled partially or to extinction to make additional syngas. The heavy baseoil can also be recycled to extinction so that the method makes 100% of the desired fuel product. In a preferred method, the naphtha is recycled to extinction and the heavy baseoil fraction is recycled so that the only product is a fuel product, such as jet fuel.

A preferred embodiment with two products comprising naphtha and jet can achieve jet yields near 80%. With naphtha recycle, there is a slight overall yield penalty but 100% jet yield may be achieved.

Referring to FIG. 1, syngas (1) may pass through feed/effluent exchanger (26) where it may be partially preheated before it enters the Fischer Tropsch reactor (2) at the top head and passes through catalyst filled tubes, producing a wide molecular distribution of hydrocarbon products. While the example shows a tubular fixed bed reactor, any type of Fischer Tropsch reactor known to one skilled in the art can be used in the method. The heavy waxy hydrocarbons may begin to condense in the catalyst pores and collect in the bottom head of the reactor. The reactor may be configured so that the portion of heavy product (4) that collects in the bottom head is removed as a liquid, which bypasses the hot separator (5). The heavy product that bypasses the enhanced hot separator may be routed to the hot separator without changing the method of the present invention. However, bypassing the enhanced hot separator may reduce the load on the separator, making it easier to operate. This heavy waxy product (4) is called HFTL for Heavy Fischer Tropsch Liquid. Gaseous product comprising unreacted syngas, inert gases and lighter hydrocarbon product (3) may also be removed from the bottom head of the reactor at a higher elevation than the HFTL product but below the bottom tubesheet of the reactor. This stream may pass through the feed/effluent exchanger (26) where it is partially cooled and sent to the enhanced hot separator (5). Hot separator (5) may be an enhanced separator in that trays or packing material may be located in the vertical tower section of the vessel and lighter products may be refluxed into the top of the vessel to enhance separation efficiency. Effectively, this hot separator may be a crude distillation tower that will greatly reduce the amount of C16 and heavier hydrocarbons in the LFTL or Light Fischer Tropsch Liquid product (14). There is a two-fold purpose to the enhanced separator design of the present invention: first, the vapor stream leaving the bottom head of the Fischer Tropsch reactor (3) may contain a fair amount of waxy components and in a simple separator, a portion of these components may get into the overhead line. When subjected to cooling, such as in cooler (10), these components may cause fowling or plugging in downstream equipment as the waxy components solidify. Thus, first; the enhanced separator reduces the chance of fowling, second; by reducing the amount of C16 and heavier hydrocarbon products in the LFTL stream, the final product properties of the fuel product may be improved because the LFTL steam bypasses the hydroprocessing reactor and, with the enhanced separator, a larger portion of molecules in the fuel product range stay in the MFTL product that is subjected to hydroprocessing, resulting in a higher degree of isomerization in the final product. The LFTL stream (14) may be split into a reflux stream (15), which may be transferred by pump (17) as reflux stream (18) into enhanced hot separator (5). The LFTL product (19) may be combined with the hydroprocessed product (20) from the hydroprocessing reactor (8). If large amounts of C8 to C16 are in the LFTL product that by-passes the stacked bed hydroprocessing reactor, the degree of isomerization must be increased to overcome the concentration of n-paraffins in the LFTL product, or the LFTL product must be separately isomerized, which would saturate alcohols in the LFTL product. By reducing the amount of C8 to C16 in the LFTL product and greatly reducing the amount of C16+ in the LFTL product, the degree of isomerization in the heavy product may be adequate to meet the cold flow requirements, i.e., a freeze point of at least −47° C. in the jet fuel product, for example, and the small amount of alcohols in the LFTL may be preserved and blended back into the hydrocracker effluent prior to distillation so they are incorporated into the final fuel product. These alcohols may improve the lubricity of the final fuel product. The liquid stream (6) coming off the bottom of the enhanced hot separator (5) may be a medium Fischer Tropsch liquid (MFTL) that contains some waxy components and therefore may be immediately combined with the HFTL product. The combined product (7) again may be referred to as combined HFTL. This heavy product must be kept hot to avoid solidification of waxes. All HFTL and combined HFTL product may be kept in heat traced lines until it gets to the hydroprocessing reactor. This product can optionally go to a rundown tank before being brought back to the hydroprocessing reactor. Once the product is hydroprocessed in the stacked bed hydroprocessing reactor, it may have a greatly reduced pour point and can be stored at ambient conditions except in the harshest environment. The hot separator (5) of the present invention, with enhanced separation efficiency, may serve as a break point between products that must be kept hot, i.e., well above ambient temperature, and products that can be cooled to normal ambient temperatures, i.e. 80 to 100° F. or less.

The combined HFTL product (7) may be passed through a hydroprocessing reactor (8) with a stacked bed of catalyst. A hydrocracking catalyst may be in one layer with a second layer of a hydroisomerization catalyst. The hydrocracking catalyst typically also has some hydroisomerization functionality. The layer of hydroisomerization catalyst may enhance the iso to n-paraffin ratio of the product. The preferred hydroisomerization catalyst may have isomerization activity in the middle distillate range so that virgin (un-cracked) product in the middle distillate range is isomerized in the stacked bed reactor. The order of the catalyst layers is not critical but in the preferred method the hydrocracking catalyst is in the top layer when the reactor is operated in a downflow manner. The ratio of hydrocracking catalyst to hydroisomerization catalyst can be any ratio to achieve the desired product properties.

The hydrocracking catalyst may be any type of hydrocracking catalyst known to one skilled in the art, such as a sulfide form of a base metal catalyst including Cobalt or Nickel containing Molybdenum or Tungsten. A preferred catalyst is a non-sulfided precious metal catalyst comprising Platinum or Palladium or combinations of the two on an inorganic oxide support, i.e., silica, alumina, silica/alumina, or zeolite. The hydroisomerization catalyst may be any hydroisomerization catalyst known to one skilled in the art but preferably one that is effective at isomerization in the middle distillate range. When a baseoil product is desired the hydroisomerization catalyst may include a catalyst that is effective at isomerization of molecules in the C20+ lube range. The hydroisomerization catalyst layer may be a mixture of two different hydroisomerization catalysts.

The light gaseous products (9) that exit the top of enhanced hot separator (5) may be cooled in cooler (10) to condense water and lighter hydrocarbon products. The cooled product stream and non-condensable gases (11) may be passed to cold separator (12) where the water and light hydrocarbons are separated from unreacted syngas and light gaseous hydrocarbon products. The water may be removed in line (13). The LFTL product may exit cold separator (12) in line (14) and may be split into two streams (15) and (19). Stream (15) may be recycled to the top of hot separator (5) as a reflux to enhance separation efficiency in separator (5). Stream (19) may be combined with hydroprocessing effluent stream (20). The combined stream (21) may go to the distillation column (22) where it is separated into three products: light naphtha (23), which may optionally be used as fuel or recycled to synthesis gas production; stream (24), which may be a fuel product such as jet, diesel, or single battlefield fuel; and stream (25), which may be a light lube baseoil or may be recycled to increase the fuel product yield. In a preferred embodiment, the method has only one product, jet fuel. In another preferred embodiment, the method of the present invention has two products: jet fuel and light baseoil. In another preferred embodiment, the method has only one diesel product or a heavy jet product, which may be referred to as a single battlefield fuel with military applications. Unreacted syngas and other non-condensable gases (16) may be purged from separator (12). Typically, a portion of stream (16) will be recycled back to the Fischer Tropsch reactor and a slipstream will be purged to fuel or partially recycled to syngas production.

Figure 2:
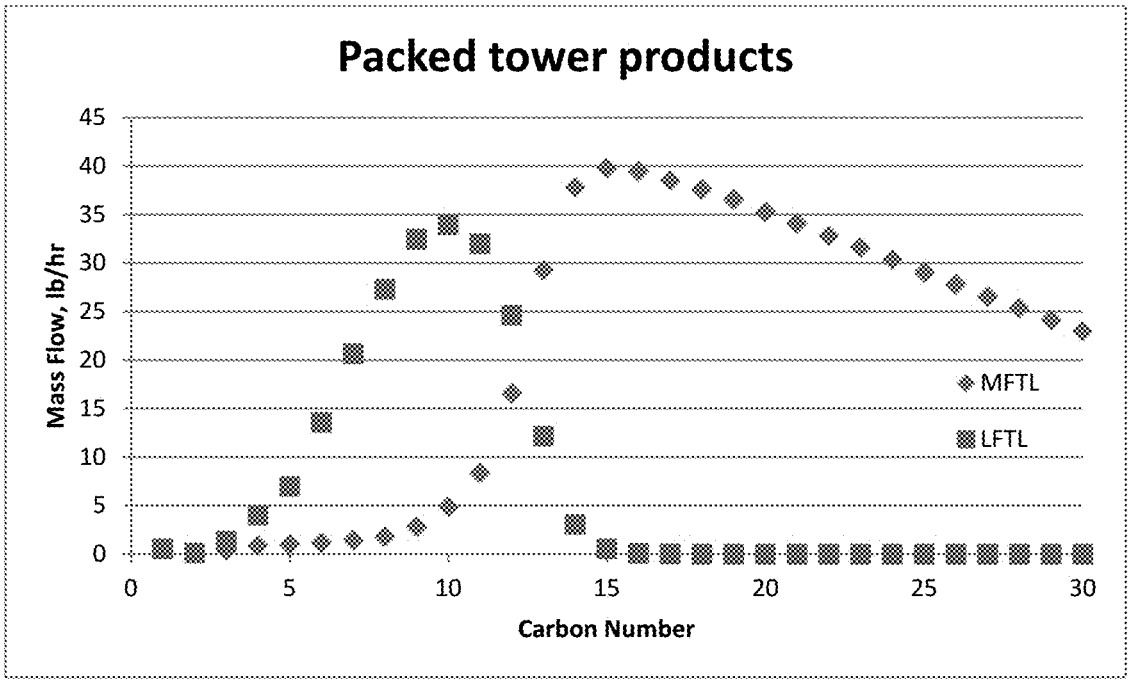
FIG. 2 is a graphical description of the separation efficiency of the enhanced hot separator of the present invention.
Figure 2:
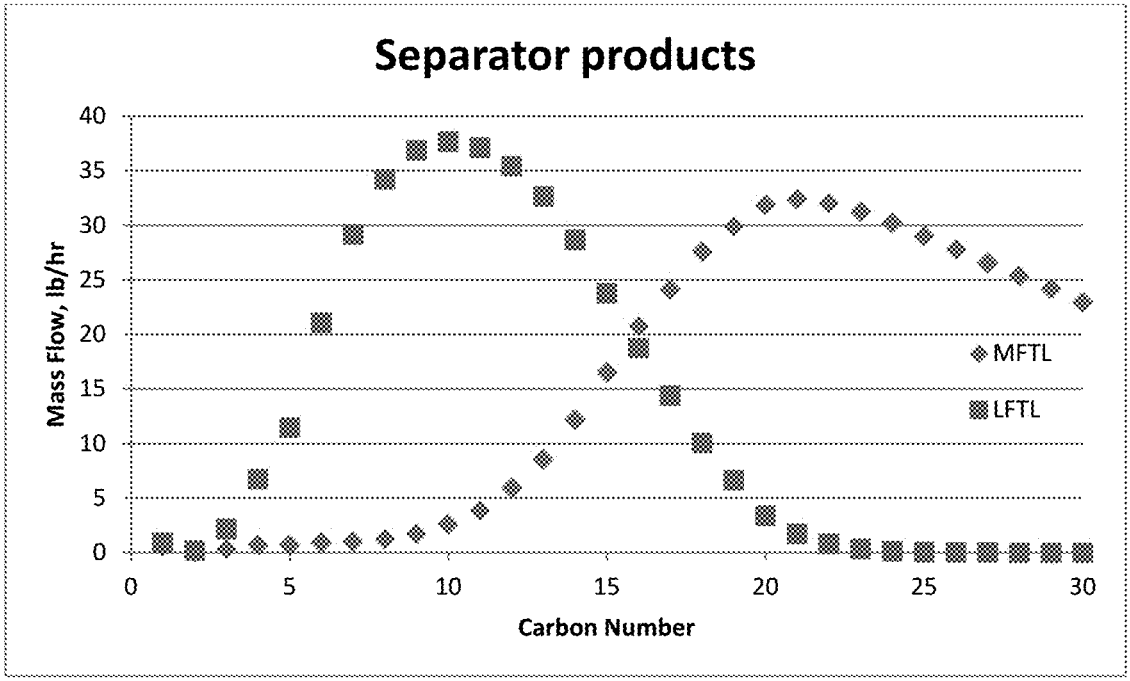

Referring to FIG. 2, the two graphs show the separation performance differences between an enhanced separator, labeled Packed Tower, and a conventional separator. The figures show product yields in lb./hr. for each carbon number from C1 to C30. It is apparent from the shape of the curves that there is more overlap of the hydrocarbon products from the simple separator. The overlap between the products is much less in the packed tower and, more importantly, the total LFTL product in the C8 to C16 range is cut by more than half with the packed tower. This improved separation efficiency puts more of the product into the MFTL where it will be combined with the HFTL and subjected to the hydroprocessing catalyst. In particular, the C8 to C16 fraction will not be cracked but will be isomerized in the reactor improving cold flow proprieties of the final product. The limited amount of C8-C16 that is in the LFTL product will bypass hydroprocessing and add valuable alcohols into the final mix without adding such a large amount that requires the combined HFTL product to be over processed to make the final jet product specification. The combination is an efficient method to make high quality fuel products, particularly a jet fuel product in high yield with a simple process configuration.

Whereas, the devices and methods have been described in relation to the drawings and claims, it should be understood that other and further modifications, apart from those shown or suggested herein, may be made within the spirit and scope of this invention.

What is claimed is:

1. A method to produce a fuel product from a Fischer Tropsch syncrude, the method comprising the steps of:

a) separating heavy Fischer Tropsch liquid (HFTL) products that are liquid at reactor temperature from a gas phase reactor effluent;

b) sending the gas phase reactor effluent to a cooler and then to an enhanced separator with improved separation efficiency to produce a medium Fischer Tropsch liquid (MFTL) intermediate product, where:

(1) a separator overhead stream is cooled and a light Fischer Tropsch liquid (LFTL) product is condensed in a cold separator;

(2) the LFTL product is separated into a reflux stream and a LFTL intermediate product stream;

(3) the reflux stream is returned to the enhanced separator; and (4) the enhanced separator has trays or packing;

c) combining the MFTL stream and the HFTL stream in a single combined HFTL stream and further processing the combined HFTL stream in a hydroprocessing reactor to produce a hydroprocessed product, where the hydroprocessing reactor has a stacked bed with a layer of hydrocracking catalyst and a layer of hydroisomerization catalyst;

d) combining the LFTL stream and the hydroprocessed product; and e) distilling the blended LFTL stream and hydroprocessed product to make naphtha, a fuel product, and a baseoil product.

2. The method of claim 1 further comprising recycling the baseoil product to the hydroprocessing reactor to extinction.

3. The method of claim 1 further comprising recycling the naphtha to use as fuel in the process or to make additional syngas.

4. The method of claim 1 further comprising recycling the naptha and the baseoil product to extinction to make a single fuel product.

5. The method of claim 4 where the single fuel product is jet fuel, diesel, or a single battlefield fuel.

6. The method of claim 1 where the Fischer Tropsch reactor uses a non-shifting Cobalt-containing catalyst.

7. The method of claim 1 where the Fischer Tropsch reactor is a fixed bed tubular reactor.

8. The method of claim 1 where the fuel product is jet fuel, diesel, or a single battlefield fuel.

9. The method of claim 1 where the fuel product has an iso to n-paraffin ratio of greater than 4:1.

10. The method of claim 1 where the hydroprocessing reactor has a severity high enough to achieve a C21+ conversion to C20− of 60% to 95%.

11. The method of claim 1 where the hydroprocessing reactor has the hydrocracking catalyst as a top layer and the hydroisomerization catalyst as a bottom layer.

12. The method of claim 1 where the hydrocracking catalyst and the hydroisomerization catalyst comprise Platinum or Palladium or a combination thereof on a support of alumina, silica, silica/alumina, or zeolite.

13. The method of claim 1 where hydroprocessing reactor has a ratio of hydrocracking catalyst to hydroisomerization catalyst from 1:99 to 99:1.

14. The method of claim 1 where the hydroprocessing reactor has a mixture of hydroisomerization catalysts with isomerization efficacy in the fuel range and in the baseoil range.

15. The method of claim 1 where the fuel product has a small amount of FT alcohol product that bypassed the hydroprocessing reactor and adds lubricity to the fuel product.

16. The method of claim 1 where the stacked bed hydroprocessing reactor has a severity high enough that the end point of the fuel product is met by the degree of hydrocracking.

* * * * *